United States Patent [19]

Cole

[11] Patent Number: 5,013,039

[45] Date of Patent: May 7, 1991

[54] SPORTS TRAINING APPARATUS

[76] Inventor: Danny R. Cole, Rt. 1, Box 224, Wayne, Okla. 73095

[21] Appl. No.: 391,456

[22] Filed: Aug. 9, 1989

[51] Int. Cl.[5] ..... A63B 67/00

[52] U.S. Cl. ..... 273/55 R

[58] Field of Search ..... 273/55 A, 55 R

[56] References Cited

U.S. PATENT DOCUMENTS

| | | | |
|---|---|---|---|
| 3,011,786 | 12/1961 | Schmuck | 273/55 R |
| 3,044,776 | 7/1962 | Weidmaier et al. | 273/55 R |
| 3,068,548 | 11/1962 | Foster et al. | 273/55 R |
| 3,365,947 | 1/1968 | Janich, III et al. | 273/55 R |
| 3,377,064 | 4/1968 | Hudson et al. | 273/55 R |
| 3,427,021 | 2/1969 | Donato | 273/55 R |
| 3,458,192 | 7/1969 | Trice, Jr. | 273/55 R |
| 3,514,105 | 5/1970 | Pillard | 273/55 R |
| 3,649,016 | 3/1972 | Kelly, Jr. | 273/55 R |
| 3,684,283 | 8/1972 | Forrest | 273/55 R |
| 3,827,690 | 8/1974 | Rogers | 273/55 R |
| 3,907,291 | 9/1975 | Parker | 273/55 R |
| 4,087,089 | 5/1978 | Forrest | 273/55 R |
| 4,186,922 | 2/1980 | Ketchum | 273/55 R |

OTHER PUBLICATIONS

Rae Crowther Co. Brochure, p. 2, Unnumbered.
World Sports & Fitness Equipment Catalong, 1989, Various Pages.
Rogers Athletic Company, 1989 Catalog, p. 2.
All American 1989 Catalog, pp. 28, 29 and 30.

*Primary Examiner*—Theatrice Brown
*Attorney, Agent, or Firm*—Dunlap, Codding, Peterson & Lee

[57] ABSTRACT

A sports training apparatus having a pad assembly pivotally connected to a frame assembly. The pad assembly is moveable from a stance position toward a raised position. The pad assembly also is moveable from a center position to a left of center position and from a center position to a right of center position.

32 Claims, 3 Drawing Sheets

SPORTS TRAINING APPARATUS

FIELD OF THE INVENTION

The present invention relates generally to a sports training apparatus having a pad assembly which is moveable from a stance position to a raised position and moveable from a center position to a right of center position and from the center position to a left of center position.

DESCRIPTION OF THE PREFERRED EMBODIMENTS

Figure 1:
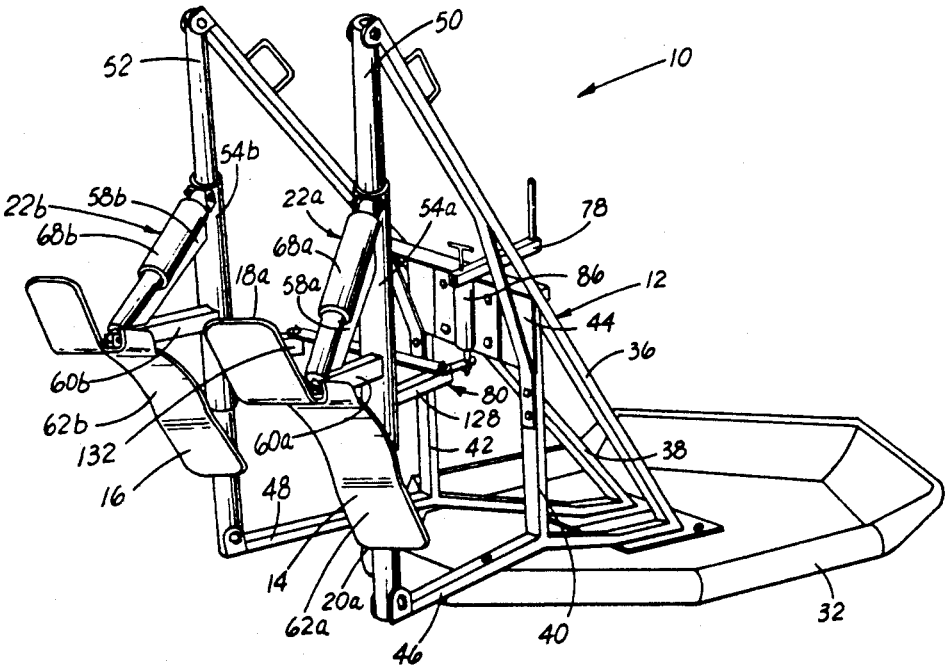
FIG. 1 is a partial perspective view of a sports training apparatus constructed in accordance with the present invention.
Figure 2:
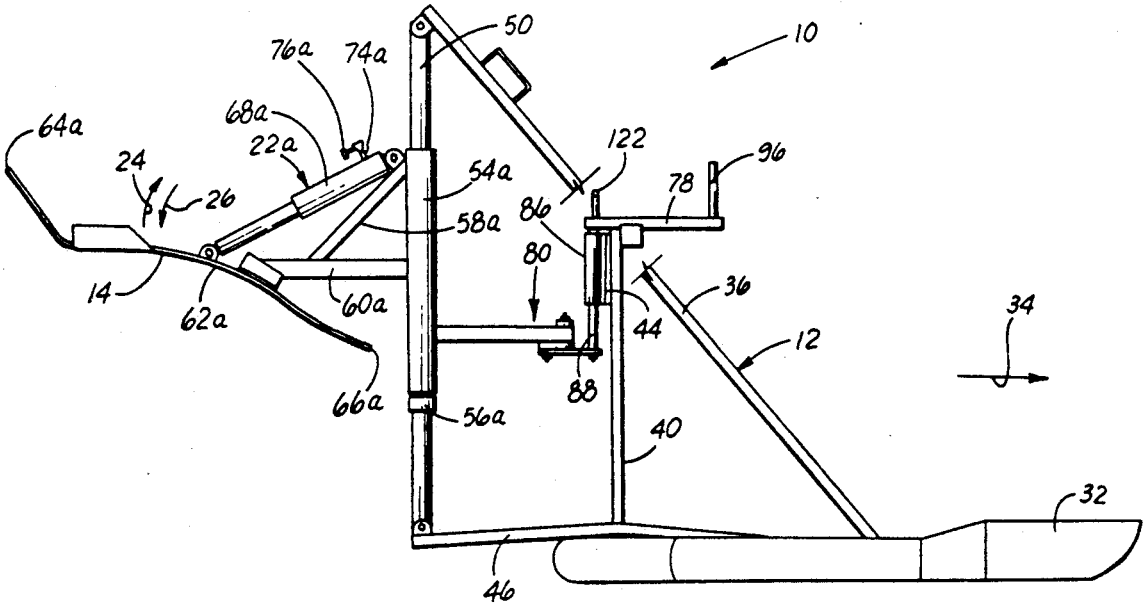
FIG. 2 is a fragmentary, partial side elevational view of a portion of the sports training apparatus of FIG. 1.
Figure 3:
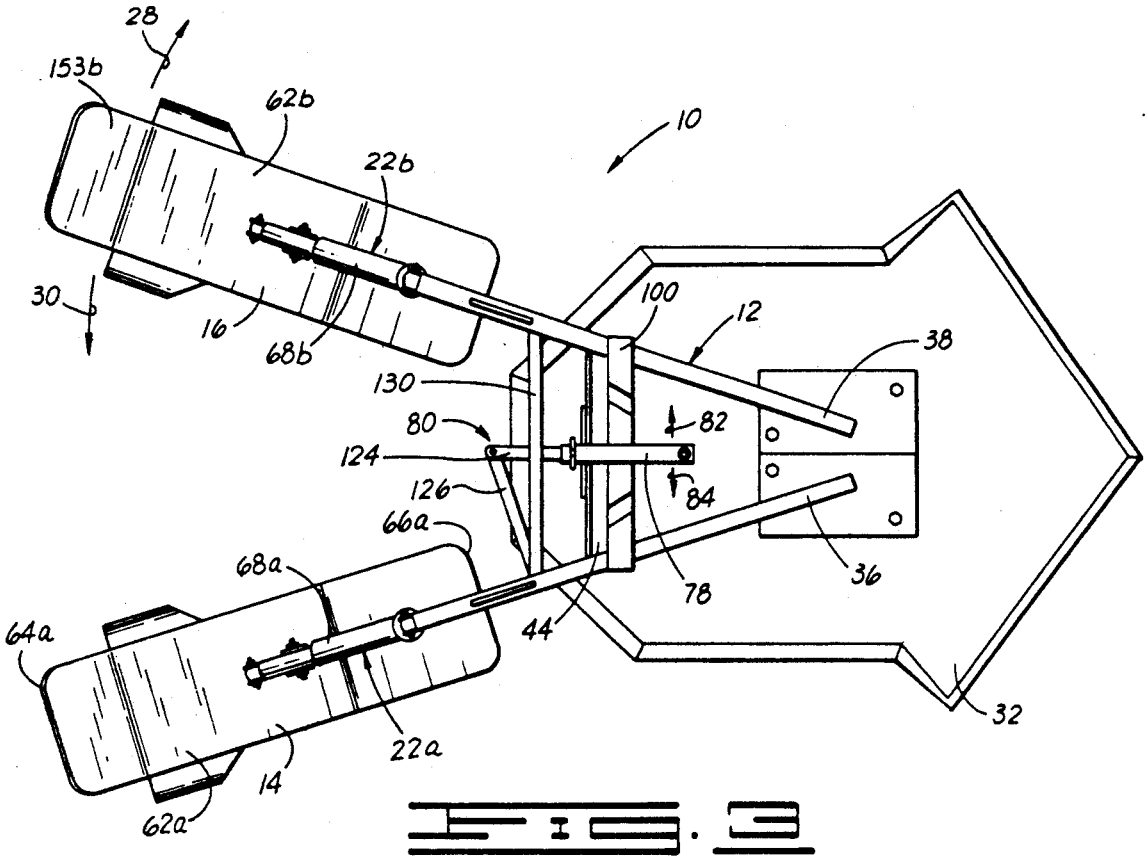
FIG. 3 is a top plan view of the sports training apparatus of FIG. 1.

Shown in FIGS. 1, 2, 3 and 4 is a sports training apparatus which is constructed in accordance with the present invention. The sports training apparatus 10 generally includes a frame assembly 12 having a first and a second pad assembly 14 and 16 connected thereto. The pad assemblies 14 and 16 each are identical in construction and operation and each comprises a pad frame (described below) and a pad (described below) connected to the pad frame, only the pad frame is shown in FIGS. 1, 2, 3 ad 4 and the pad is shown in FIG. 5.

The sports training apparatus 10 particularly is useful in training lineman in the sport of football. In use, a lineman would line up generally in front of one the pad assemblies 14 and 16. The coach generally stands on a portion of the frame assembly 12. Upon proper command by the coach, the lineman moves forward and strikes the pad assembly 14 or 16.

The first and the second pad assemblies 14 and 16 each include an upper end and a lower end. Each pad assembly 14 and 16 is pivotally connected to the frame assembly 14 at a position generally midway between the upper and lower ends of the respective pad assemblies 14 and 16. Each of the pad assemblies 14 and 16 is pivotally movable from a stance position (shown in FIG. 2 with respect to the pad assembly 14, shown in FIG. 3 with respect to the pad assemblies 14 and 16 and shown in FIG. 4 with respect to the pad assembly 14) to a raised position (shown in FIG. 1 with respect to the pad assemblies 14 and 16, and shown in FIG. 4 with respect to the pad assembly 16). A resistive means 22 is connected to each of the pad assemblies 14 and 16 for resistively tending to hold or bias the pad assemblies 14 and 16 toward the stance position (the resistive means being designated in the drawings by the respective reference numerals 22*a* and 22*b*).

When the pad assembly 14 or 16 is struck by the player, the resistive means 22 applies an adjustable resistive force against which the player moves the pad assembly 14 or 16 in a direction 24 (FIG. 2) from the stance position generally toward the raised position. This movement of the pad assembly 14 or 16 simulates the movement of a lineman as another lineman strikes the lineman and attempts to bring the lineman to a standup or upright position. The resistive force is controllingly variable so that the amount of the resistive force can be varied for training individuals of varying strengths and ages. Each of the pad assemblies 14 and 16 also is pivotally movable in a direction 26 (FIG. 2) from a raised position to the stance position when the force of the player has been removed from the pad assembly 14 or 16. In other words, once the player disengages from the pad assembly 14 or 16, the pad assembly 14 or 16 automatically is moved via the resistive means 22 in the direction 26 back to the stance position. It also should be noted that in use the pad assembly 14 or 16 will not always be moved by the player to the fully raised position, but, rather, the player may move the pad assembly 14 or 16 to a position intermediate of the fully raised position and stance position, and this intermediate position is included in the term "raised position" as such term is used herein.

Each of the pad assemblies 14 and 16 is movable a predetermined distance from a center position (shown in the drawings) in a left direction 28 (FIG. 2) to a predetermined left of center position wherein the left of center position is spaced a distance generally to the left of the center position. Each of the pad assemblies 14 and 16 also is movable in a right direction 30 (FIG. 3) to a position spaced a predetermined distance to the right of the center position. The pad assemblies 14 and 16 are movable from the center position to the right of center position and to the left of center position by a coach standing on the frame assembly 12. The terms "right" and "left" as used herein with respect to the directions 28 and 30 are from the perspective of lineman facing the pad assemblies 14 and 16.

In use, the pad assemblies 14 and 16 initially are positioned in the center position. The player then lines up generally across from one of the pad assemblies 14 and 16.

When a blocker hits an opponent, the object is to stand the opponent upright so that the blocker can control the opponent and move the opponent in a desired direction. The pivotal movement of the pad assemblies 14 and 16 from the stance position to the upright position as the blocker hits the pad assembly 14 or 16 and drives into the pad assembly 14 or 16 against the resistive force provided via the resistive means 22 gives the blocker a realistic simulation of standing an opponent upright and controlling the opponent.

The movement of the pad assemblies 14 and 16 in the left and right directions 28 and 30 gives the defensive lineman realistic head reads. When the pad assembly 14 or 16 is moved in the left direction 28, the defensive lineman reads this movement as a movement of the offensive lineman's head to the defensive lineman's left. This movement indicates to the defensive lineman that the blocking force will be applied in a direction tending to move the defensive lineman to the defensive lineman's right. When read properly, the defensive lineman should react to this movement by hitting the pad assembly 14 or 16 with the defensive lineman's opposite forearm (the defensive lineman's right forearm) and attempt to move the pad assembly 14 or 16 from the stance position to the upright position. By the same token, when the pad assembly 14 or 16 is moved in the right direction 30 to the right of center position (to the defensive lineman's right), this should indicate to the defensive lineman that the force applied by the offensive lineman is going to be in a direction generally toward the defensive lineman's left (the defensive lineman's right to left direction). The defensive lineman should react to this movement by striking the pad assembly 14 or 16 with the defensive lineman's opposite forearm (the defensive lineman's left forearm) and driving into the pad assembly 14 or 16 driving the pad assembly 14 or 16 from the stance position generally toward the upright or raised position against the resistive force applied via the resistive means 22.

The sports training apparatus 10 of the present invention thus is useful in teaching defensive lineman to read the head movements of offensive lineman and to react in such a manner as to apply force to the offensive lineman tending to force the offensive lineman in the direction of the play and against the direction of force being applied by the offensive lineman. The sports training apparatus 10 also simulates the movement of the blocked lineman as the blocker attempts to move the blocked lineman from the stance position to the upright or raised position.

The frame assembly 12 includes a slide plate 32 which is shaped and adapted to be slidingly disposed on the ground. When the pad assemblies 14 or 16 are hit by a player, the player continues to apply force to the pad assemblies 14 or 16 thereby slidingly moving the slide plate 32 in a general direction 34 (FIG. 2). Such movement continues until the coach gives a stop command.

A pair of frame bars 36 and 38 are connected to the slide plate 32 and each of the frame bars 36 and 38 extends a distance generally upwardly from the slide plate 32. One end of a brace bar 40 (FIG. 1, 2 and 4) is connected to the slide plate 32 and the opposite end of the brace bar 40 is connected to the frame bar 36. One end of a brace bar 42 (FIGS. 1 and 4) is connected to the slide plate 32 and the opposite end of the brace bar 40 is connected to the frame bar 38. The brace bars 40 and 42 cooperate to provide structural strength for supporting the frame bars 36 and 38. A brace plate 44 is connected to the upper ends of the brace bars 40 and 42 and the brace plate 44 extends generally between the brace bars 40 and 42.

One end of a lower frame bar 46 (FIGS. 1 and 2) is connected to the slide plate 32 and the lower frame bar 46 extends a distance from the slide plate 32. One end of a lower frame bar 48 (FIG. 1) is connected to the slide plate 32 and the lower frame bar 48 also extends a distance from the slide plate 32.

One end of a pad support bar 50 (FIGS. 1, 2 and 4) is connected to the frame bar 36 and the opposite end of the pad support bar 50 is connected to the lower frame bar 46. One end of a pad support bar 52 (FIGS. 1 and 4) is connected to the frame bar 38 and the opposite end of the pad support bar 52 is connected to the lower frame bar 48. The pad support bars 50 and 52 thus are secured to the frame assembly 12 and the pad support bars 50 and 52 each are spaced a distance from the slide plate 32 portion of the frame assembly 12. The pad support bars 50 and 52 are spaced a distance apart and the pad support bars 50 and 52 each extend in a generally vertical direction from the ground surface generally perpendicularly direction with respect to the slide plate 32.

The sports training apparatus 10 includes a pair of pad sleeves 54 (the pad sleeves being designated in the drawings by the respective numerals **54*a* and 54*b*), as shown in FIGS. 1, 2 and 3. Each pad sleeve 54 is generally circularly shaped in one cross section and includes a circular shaped opening extending through the pad sleeve 54 and intersecting the opposite ends of the pad sleeve 54. The pad support bar 50 is slidingly disposed in the opening in the pad sleeve 54*a* and the pad support bar 52 is slidingly disposed in the opening in the pad sleeve 54*b***.

Figure 4:
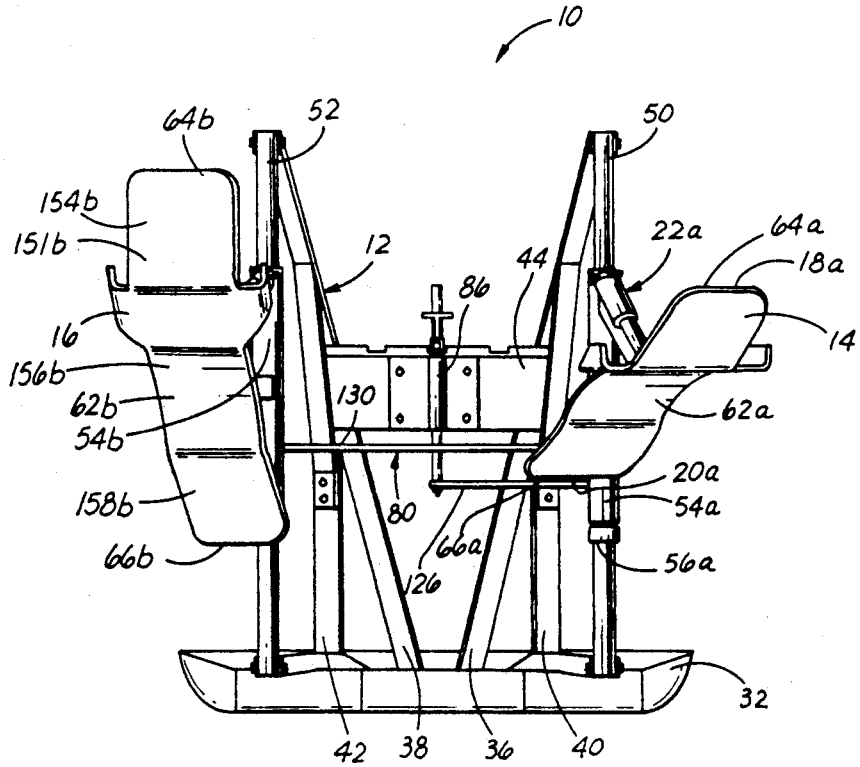
FIG. 4 is a front elevational view of the sports training apparatus of FIGS. 1 and 2.
Figure 5:
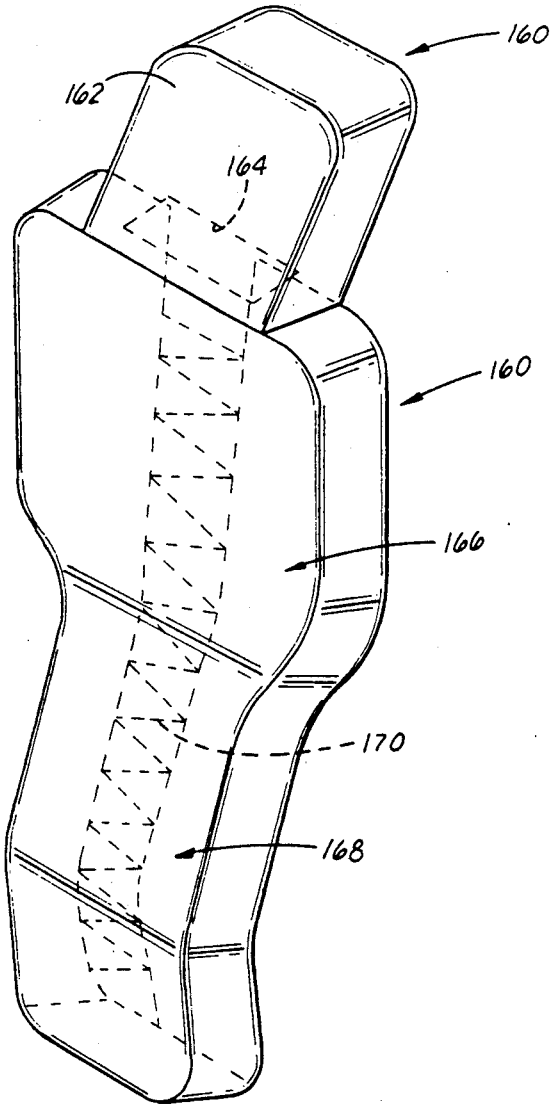
FIG. 5 is a partial perspective view of a pad constructed in accordance with the present invention.

The sports training apparatus 10 also includes a pair stop 56 (only the stop **56*a* is shown in FIGS. 2 and 4). Each stop 56 is generally circularly shaped in one cross section and includes an opening extending therethrough and intersecting the opposite ends thereof. The pad support bar 50 is disposed in the opening and the stop 56*a* and the stop 56*a* is secured in a predetermined position on the pad support bar 50 with the pad sleeve 54*a* disposed generally above the stop 56*a*. The stop 56*a* is adapted to engage one end of the pad sleeve 54*a* to limit the movement of the pad sleeve 54*a* in a downward direction thereby cooperating to secure the pad sleeve 54*a* in a predetermined position on the pad support bar 50**.

The pad support bar 52 is disposed in the opening and the other stop 56 (not shown) and this stop 56 is secured in a predetermined position on the pad support bar 52 with the pad sleeve **54*b* disposed generally above this stop 56. This stop 56 is adapted to engage one end of the pad sleeve 54*b* to limit the movement of the pad sleeve 54*b* in a downward direction thereby cooperating to secure the pad sleeve 54*b* in a predetermined position on the pad support bar 52**.

The sports training apparatus 10 also includes a pair of pad braces bar 60 (the respective pad brace bars being designated in the drawings by the respective numerals **60*a* and 60*b*). One end of the pad brace bar 60*a* is connected to the pad sleeve 54*a* and the pad brace bar 60*a* extends a distance generally outwardly from the pad sleeve 54*a*. One end of the pad brace bar 60*b* is connected to the sleeve 54*b* and the pad brace bar 60*b* extends a distance generally outwardly from the pad sleeve 54*b***.

The sports training apparatus 10 also includes a pair of pad support arms 58 (the respective pad support arms being designated in the drawings by the respective reference numerals **58*a* and 58*b*). One end of the pad support arm 58*a* is connected to the pad sleeve 54*a* and the opposite end of the pad support arm 58*a* is connected to the pad brace bar 60*a* at a position generally between the opposite ends of the pad brace bar 60*a*. One end of the pad support arm 58*a* is connected to the pad sleeve 54*b* and the opposite end of the pad support arm 58*b* is connected to the pad brace bar 60*b* at a position generally between the opposite ends of the pad brace bar 60*b***.

Each pad assembly 14 and 16 also includes a pad frame 62 (respective pad frame 62 being designated in the drawings by the respective reference numerals **62*a* and 62*b*). Each pad frame 62 has an upper end 64 and a lower end 66 (the respective upper and lower ends being designated in the drawings by the reference numerals 64*a* and 66*a* and 64*b* and 66*b*). The pad frame 62*a* is pivotally connected to the pad brace bar 60*a* at a position generally between the upper and the lower ends 64*a* and 66*a* of the pad frame 62*a*. The pad frame 62*b* is connected to the pad brace bar 60*b* at a position generally between the upper and the lower ends 64*b* and 66*b* of the pad frame 62*b*. The pivotal connection between the pad frames 62*a* and 62*b* and the respective pad brace bars 60*a* and 60*b*** permit each of the pad frames 62 to be moved in the direction 24 (FIG. 2) generally from the stance position toward the raised position and to be pivotally moved in the direction 26 (FIG. 2) generally from the raised position generally toward the stance position.

The resistive means 22 includes a fluid cylinder 68 (the respective fluid cylinders 68 being designated in the drawings by the respective reference numerals 68*a* and 68*b*). Each fluid cylinder 68 has a cylinder base and a cylinder rod reciprocatingly disposed within the cylinder base. The cylinder base of the fluid cylinder 68*a* is pivotally connected to the pad brace bar 60*a* and the cylinder base of the fluid cylinder 68*b* is pivotally connected to the pad brace bar 60*b*. The cylinder rod of the fluid cylinder 68*a* is pivotally connected to the pad frame 62*a* and the cylinder rod of the fluid cylinder 68*b* is pivotally connected to the pad frame 62*b*. Each fluid cylinder 68 includes a cylinder port 74 (the cylinder port 74*a* being shown in FIG. 2). A valve 76 is connected to each of the cylinder ports 74 (the valve 76*a* being shown in FIG. 2). Each of the valve 76 is connectible to a fluid supply such as an air source for pumping air through the cylinder port 74 and into the cylinder base.

In one preferred form, the fluid cylinders 68 are air cylinders. Such air cylinders are commercially available and one air cylinder suitable for use in the present invention is manufactured by Rockhill Air Shocks, Model No. 49155W-P7104JJ, for example. The fluid cylinders 68 are adapted such that air can be pumped into the cylinder base via the value 76 and cylinder port 74 for increasing the force required to move the cylinder rod into the cylinder base. The valve 76 is adapted such that the valve can be opened for bleeding fluid from the cylinder base thereby decreasing the force required to move the cylinder rod into the cylinder base.

The pad support arms 60 are rotatingly supported on the respective pad support bars 50 and 52 via the pad sleeves 54 for rotation in the left and the right directions 28 and 30. The pad sleeves 54 each are connected to a handle 78 (FIGS. 1, 2 and 3) via a linkage assembly 80 (FIGS. 1, 2 and 3). The handle 78 is rotatingly movable in a direction 82 (FIG. 3) or a direction 84 (FIG. 3). When the handle 78 is rotatingly moved in the direction 82, the linkage assembly 80 causes the pad sleeves 84 each to be rotatingly moved in the left direction 28 thereby moving the respective pad assemblies 14 and 16 in the left direction 28. When the handle 78 is moved in the direction 84, the pad sleeves 54 each are caused to be moved in the right direction 30 via the linkage assembly 80 thereby causing the pad assemblies 14 and 16 each to be moved in the right direction 30.

The linkage assembly 80 comprises a handle cylinder 86 having opposite ends and an opening extending therethrough intersecting the opposite ends thereof. The handle cylinder 86 (FIGS. 1, 2 and 4) is connected to the brace plate 44. A handle rod 88 (FIG. 2) is disposed through the opening in the handle cylinder 86 and the handle rod 88 is rotatingly disposed in the handle cylinder 86. The handle rod 88 has opposite ends. One end of the handle rod 88 is connected to one end of the handle 78. A grip bar 96 (FIG. 2) is secured to one end of the handle 78 and the grip bar 96 extends a distance from the handle 78 and is adapted to provide a gripping area so that an individual may grip the grip bar 96 and move the handle 78 in the direction 82 or 84.

A guide block 100 (FIGS. 3 and 6) is secured to the brace plate 44. The guide block 100 has an upper surface 102. The handle 78 extends generally across the upper surface 102 of the guide block 100 and a portion of the handle 78 rests generally on the upper surface 102 of the guide block 100.

Figure 6:
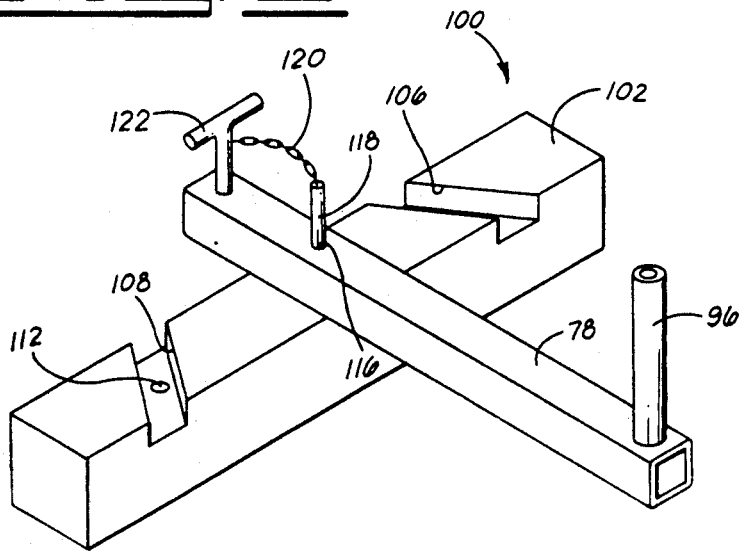
FIG. 6 is a partial perspective view showing the handle and guide block portion of the sports training apparatus of the present invention.

As shown in FIG. 6, a left groove 106 is formed in the upper surface 102 of the guide block 100 and left groove 106 is spaced a distance in generally the left direction 28 from the center of the guide block 100. A right groove 108 is formed in the upper surface 102 of the guide block 100 and the right groove 108 is spaced a distance generally in the right direction 30 from the center of the guide block 100. Each of the grooves 106 and 108 is sized to receive a portion of the handle 78. An opening 116 is formed through a portion of the handle 78. An opening is formed in each of the grooves 106 and 108 and each of the openings in each of the grooves 106 and 108 is alignable with the opening 116 formed in the handle 78 (only one of the openings in the grooves being shown in FIG. 6, that is an opening 112 in the right groove 108 although the openings in the left groove 106 is formed and positioned in a similar manner).

When the pad assemblies 14 and 16 are positioned in the center position, a portion of the handle is disposed on upper surface 102, as shown in FIG. 6. The pin 118 is connected to the handle 78 via a chain 120 to reduce the chances the pin 118 might be lost.

When it is desired to move the pad assemblies in the left direction 28 to the left of center position, the handle 78 is moved in the direction 82 to a position wherein a portion of the handle 78 is disposed in the left groove 106. The guide block 100 cooperates to maintain the handle 78 in this position disposed in the left groove 106 thereby cooperating to maintain the pad assemblies 14 and 16 in the left of center position. The pin 118 may be disposed through the opening 116 and into the opening in the left groove 116 for cooperating to maintain the handle 78 securely positioned in the left groove 106 thereby cooperating to maintain the pad assemblies 14 and 16 in the left of center position.

When it is desired to move the pad assemblies 14 and 16 to the right of center position, the handle 78 is moved in the direction 84 to a position wherein the handle 78 is disposed in the right groove 108 thereby causing the pad assemblies 14 and 16 to be moved in the right direction 30 to the right of center position. When the portion of the handle 78 is disposed in the right groove 108, the pin 118 again can be disposed through the opening 116 and the handle 78 and into the opening 112 in the right groove 108 for cooperating to secure the handle 78 in the right groove 108 thereby cooperating to secure the pad assemblies 14 and 16 in the right of center position.

A T-bar 122 (FIG. 6) is connected to one end of the handle 78, opposite the end having the grip 96 connected thereto. The T-bar 122 is adapted to be grip by an individual for assisting and moving the handle 78 out of the groove 106 or 108 during the operation of the sports training apparatus 10.

The linkage assembly 80 comprises a first link member 124 (shown in FIG. 3) having one end connected to the lower end of the handle rod 88. The opposite end of the first link member 124 is pivotally connected to a second link member 126 (FIGS. 3 and 4). The opposite end of the second link member 126 is pivotally connected to one end of a center link member 130 (FIGS. 3 and 4) and to one end of a first pad link member 128 (FIG. 1). The opposite end of the center link member 130 is pivotally connected to one end of a second pad link member 132 (FIG. 1). The opposite end of the first pad link member 128 is securely connected to the pad sleeve 54*a* and the opposite end of the second pad link member 132 is securely connected to the pad sleeve 54*b*.

Each pad frame 62 has a front surface 151 (FIG. 4) and a rear surface 153 (FIG. 3). Each pad frame 62 has a head portion 154 (FIG. 4), a torso portion 156 (FIG. 4) and a leg portion 158 (FIG. 4).

The head portion 154 is formed on the pad frame 62 generally near the upper end 64 with the head portion 154 extending a distance generally upwardly at an angle to the ground surface in the stance position of the pad frame 62. The torso portion 156 is disposed generally between the upper and the lower ends 64 and 66 of the pad frame 62.

The torso portion 156 extends a distance from the head portion 154 generally toward the lower end 66 of the pad frame 62. The torso portion 156 extends at an angle to the head portion 154. The torso portion 156 extends about parallel to the ground surface in the stance position in the pad frame 62.

The leg portion 158 extends a distance from the torso portion 154 generally toward the lower end 66 of the pad frame 62. The leg portion 158 extends at an angle from the torso portion 156. The leg portion 158 extends at an angle to the ground surface in the stance position of the pad frame 62.

A pad 160 (FIG. 5) generally covers each of the pad frames 62. The pad 160 includes a head portion 162 with an opening 164 formed through one end thereof. The head portion 154 of the pad frame 62 is disposable through the opening 164 and the head portion 162 of the pad 160 is shaped and adapted to substantially encompass the head portion 154 of the pad frame 62 with the head portion 162 generally surrounding the front and rear surfaces 151 and 153 on the head portion 154 of the pad frame 162.

The pad 160 also includes a torso portion 166 extending from the head portion 162 and a leg portion 168 extending a distance from the torso portion 166. The torso and leg portion 166 and 168 are shaped so that the torso portion 166 and leg portion 168 are disposed generally on the portion of the front surface 151 formed by the torso and leg portions 156 and 158 of the pad frame 162. The torso portion 166 and the leg portion 168 substantially encompass the portion of the front surface 151 formed by the torso portion 156 and the leg portion 158 of the pad frame 162. A portion of the torso portion 166 and a portion of the leg portion 168 of the pad 160 extend over the pad frame 162 and encompasses a portion of the rear surface 153 formed by the torso portion 156 and the leg portion 158 of the pad frame 162. The torso portion 166 and the leg portion 168 are secured on the pad frame 162 via lacing 170.

Each pad assembly 14 and 16 is shaped to simulate the appearance of a lineman in the stance position. The head portions 154 and 162 simulate the lineman's head in the stance position of the lineman. The torso portions simulate the appearance of the lineman's torso in the stance position of the lineman. The leg portions 158 and 168 simulate a portion of the lineman's legs in the stance position of the lineman.

Changes may be made in the construction and the operation of the various components, elements and assemblies described herein with respect to the sports training apparatus 10 without departing from the spirit and scope of the invention as defined in the following claims.

What is claimed is:

1. A sports training apparatus supportable on a ground surface and adapted to assist in training a lineman in the sport of football, comprising:

a frame assembly supportable on the group surface;

a pad assembly having an upper end and a lower end and being adapted to be engageable by a lineman, the pad assembly having a head portion near the upper end and a torso portion disposed between the upper and lower ends of and extending a distance from the head portion toward the lower end, the head portion extending a distance at an angle from the torso portion;

means pivotally connecting the pad assembly to the frame assembly whereby the pad assembly is pivotally moveable from a stance position toward a raised position and pivotally moveable from the raised position to the stance position, the upper end of the pad assembly being moveable in a direction toward the frame assembly as the pad assembly moves toward the raised position and the upper end of the pad assembly being moveable in a direction away from the frame assembly as the pad assembly moves toward the stance position, the head portion of the pad assembly extending at an angle to the ground surface in the stance position and the torso portion extending about parallel with the ground surface in the stance position, and the torso position being movable toward a position extending generally perpendicular to the ground surface as the pad assembly is moved toward the raised position;

means connecting the pad assembly to the frame assembly for movement of the pad assembly in a left direction a distance from a center position in a right direction a distance from the center position and for movement back to the center position; and means connected to the pad assembly for moving the pad assembly to and from said positions; and means for locking the pad assembly in the center position, and for locking the pad assembly in the left of center position and for locking the pad assembly in the right of center position.

2. The sports training apparatus of claim 1 further comprising:

resistive means for resisting movement of the pad assembly in a direction from the stance position toward the raised position, the pad assembly being moveable toward the raised position against a resistive force applied by the resistive means.

3. The sports training apparatus of claim 2 wherein the resistive means applies an adjustably variable resistive force.

4. The sports training apparatus of claim 1 wherein the pad assembly further comprises:

a pad frame having a front surface, a rear surface, an upper end and a lower end, a head portion being formed on the frame assembly near the upper end with the head portion extending upwardly at an angle to the ground surface in the stance position of the pad assembly, and a torso portion disposed between the upper and lower ends of the pad frame and extending a distance from the head portion toward the lower end of the pad assembly with the torso portion extending at an angle to the head portion and with the torso portion extending about parallel to the ground surface in the stance position of the pad assembly, and a leg portion extending a distance from the torso portion to the lower end of the pad frame with the leg portion extending at an angle form the torso portion and with the leg portion extending at an angle to the ground surface in the stance position of the pad assembly; and a pad connected to the pad frame and extending generally over and covering the front surface of the pad frame.

5. The sports training apparatus of claim 4 wherein the pad and the pad frame are shaped to simulate the appearance of an individual in the stance position with the head portion simulating the individual's head, the torso portion simulating the individual's torso and the leg portion simulating a portion of the individual's leg.

6. The sports training apparatus of claim 4 wherein the pad includes a head portion with an opening, the head portion of the pad frame being disposable through the opening in the head portion of the pad with the head portion of the pad extending generally over the front surface and the rear surface and generally encompassing the head portion of the pad frame, the remaining portion of the pad extending over the front surface and a portion of the rear surface of the pad frame, and wherein the apparatus further comprises:

means for securing the pad to the pad frame.

7. The sports training apparatus of claim 1 wherein the means pivotally connecting the pad assembly to the frame assembly is defined further as pivotally connecting the pad assembly to the frame assembly at a position about midway between the upper and lower ends of the pad assembly.

8. A sports training apparatus supportable on a ground surface and adapted to assist in training a lineman in the sport of football, comprising:

a frame assembly supportable on the ground surface;

a pad assembly having upper and lower ends and being adapted to be engaged by the lineman;

means pivotally connecting the pad assembly to the frame assembly for movement of the pad assembly a distance in a left direction from a center position to a left of center position and for movement of the pad assembly a distance in a right direction from the center position to a right of center position and for movement of the pad assembly to the center position; and means connected to the pad assembly for moving the pad assembly to the center position, the left of center position and the right of center position, and wherein the frame assembly further comprises:

a pad support bar extending in a plane generally perpendicular to the ground support surface; and wherein the means for movably connecting the pad assembly to the frame assembly further comprises:

a pad sleeve rotatingly connected to the pad support bar for rotation in a left direction and for rotation in a right direction; and a pad support arm having one end connected to the pad sleeve and an opposite end pivotally connected to the pad assembly; and wherein the sports training apparatus further comprises:

resistive means for resisting movement of the pad assembly from the stance position toward the raised position, the pad assembly being moveable toward the raised position against a resistive force applied by the resistive means.

9. The sports training apparatus of claim 8 further comprising:

means for locking the pad assembly in the center position, and for locking the pad assembly in the left of center position when the pad assembly has been moved to the left of center position, and for locking the pad assembly in the right of center position when the pad assembly has been moved to the right of center position.

10. The sports training apparatus of claim 8 wherein the means for moving the pad assembly to the left of center position, to the right of center position and to the center position further comprises:

a handle;

means for connecting the handle to the pad sleeve, the handle being moveable for rotating the pad sleeve and moving the pad assembly from the center position a distance generally in the left direction to the left of center position, and the handle being moveable for rotating the pad sleeve and moving the pad assembly in the right direction from the center position a distance generally in the right direction to the right of center position.

11. The sports training apparatus of claim 10 wherein the means for connecting the handle to the pad sleeve comprises:

a handle rod having one end connected to the handle;

means rotatably supporting the handle rod on the frame assembly; and link member means connecting the handle rod to the pad sleeve.

12. The sports training apparatus of claim 11 further comprising:

a guide block connected to the frame assembly having an upper surface, a portion of the handle extending over the upper surface of the guide block, a right groove formed in the upper surface spaced a distance from the center of the guide block, and a left groove formed in the upper surface spaced a distance from the center of the guide block, a portion of the handle being disposed in the right groove when the pad assembly is in the right of center position, and a portion of the handle being disposed in the left groove when the pad assembly is in the left of center position.

13. The sports training apparatus of claim 12 further comprising:

means for securing the handle to the guide block when the handle is positioned in the left groove or the right groove.

14. The sports training apparatus of claim 8 wherein the pad assembly further comprises:

a pad frame having a front surface, a rear surface, an upper end and a lower end, a head portion being formed on the frame assembly near the upper end with the head portion extending upwardly at an angle to the ground surface in the stance position of the pad assembly, and a torso portion disposed between the upper and lower ends of the pad frame and extending a distance from the head portion toward the lower end of the pad assembly with the torso portion extending at an angle to the head portion and with the torso portion being extending about parallel to the ground surface in the stance position of the pad assembly; and a pad connected to the pad frame and extending over and covering the front surface of the pad frame.

15. The sports training apparatus of claim 14 wherein the pad includes a head portion with an opening, the head portion of the pad frame being disposable through the opening, in the head portion of the pad with the head portion of the pad extending generally over the front surface and the rear surface and generally encompassing the head portion of the pad frame, the remaining portion of the pad extending over the front surface and a portion of the rear surface of the pad frame, and wherein the apparatus further comprises:

means securing the pad to the pad frame.

16. The sports training apparatus of claim 8 wherein the means pivotally connecting the pad assembly to the frame assembly is defined further as pivotally connecting the pad assembly to the frame assembly at a position generally about midway between the upper and lower ends of the pad assembly.

17. A sports training apparatus supportable on a ground surface and adapted to assist in training an individual, comprising:

a frame assembly supportable on the ground surface, comprising:

a pad support bar extending in a plane generally perpendicular to the ground support surface;

a pad assembly having an upper end and a lower end;

means for supporting the pad assembly on the frame assembly in a stance position wherein the pad assembly is disposed at a predetermined angle with respect to the ground surface and for pivotally connected the pad assembly to the frame assembly whereby the pad assembly is pivotally movable from the stance position toward a raised position and pivotally movable from the raised position to the stance position, the upper end of the pad assembly being movable in a direction toward the frame assembly as the pad assembly moves toward the raised position and the upper end of the pad assembly being movable in a direction away from the frame assembly as the pad assembly moves toward the stance position;

a pad sleeve rotatingly connected to the pad support bar for rotation in a left direction and for rotation in a generally right direction; and a pad support arm having one end connected to the pad sleeve and an opposite end pivotally connected to the pad assembly; and a handle;

means for connecting the handle to the pad sleeve, the handle being moveable for rotating the pad sleeve and moving the pad assembly from a center position a distance generally in a left direction to a left of center position, and the handle being moveable for rotating the pad sleeve and moving the pad assembly in a right direction from the center position a distance in a right direction to a right of center position, comprising:

a handle rod having one end connected to the handle;

means rotatably supporting the handle rod on the frame assembly; and link member means connecting the handle rod to the pad sleeve; and resistive means cooperating to support the pad assembly in the stance position and resisting movement of the pad assembly from the stance position toward the raised position, the pad assembly being moveable toward the raised position against a resistive force applied by the resistive means.

18. The sports training apparatus of claim 17 further comprising:

a guide block connected to the frame assembly having an upper surface, a portion of the handle extending over the upper surface of the guide block, the guide block having a right groove formed in the upper surface spaced a distance from a center of the guide block and a left groove formed in the upper surface spaced a distance from the center of the guide block, a portion of the handle being disposed in the right groove when the pad assembly is in the right of center position, and a portion of the handle being disposed in the left groove when the pad assembly is in the left of center position.

19. The sports training apparatus of claim 18 further comprising:

means securing the handle to the guide block when the handle is positioned in the left groove or the right groove.

20. A sports training apparatus supportable on a ground surface and adapted to assist in training a lineman in the sport of football, comprising:

a frame assembly supportable on the ground surface, comprising:

a pad support bar extending in a plane generally perpendicular to the ground support surface; and a pad assembly adapted to be engaged by the lineman having an upper end and a lower end;

means movably connecting the pad assembly to the frame assembly for movement of the pad assembly a distance in a generally left direction from a center position to a left of center position and for movement of the pad assembly a distance in a generally right direction from the center position to a right of center position and for movement of the pad assembly to the center position, comprising:

a pad sleeve rotatably connected to the pad support bar for rotation in a left direction and for rotation in a right direction; and a pad support arm having one end connected to the pad sleeve and an opposite end pivotally connected to the pad assembly; and means supporting the pad assembly on the frame assembly in a stance position wherein the pad assembly is disposed at a predetermined angle with respect to the ground surface and for pivotally connecting the pad assembly to the frame assembly whereby the pad assembly is pivotally movable from the stance position toward a raised position and pivotally moveable from the raised position to the stance position, the upper end of the pad assembly being movable in a direction toward the frame assembly as the pad assembly moves toward the raised position and the upper end of the pad assembly being movable in a direction away from the frame assembly as the pad assembly moves toward the stance position;

resistive means for resisting movement of the pad assembly from the stance position toward the raised position, the pad assembly being moveable toward the raised position against a resistive force applied by the resistive means.

21. The sports training apparatus of claim 20 further comprising:

a handle;

means connecting the handle to the pad sleeve, the handle being moveable for rotating the pad sleeve and moving the pad assembly from the center position a distance generally in the left direction to the left of center position, and the handle being moveable for rotating the pad sleeve and moving the pad assembly in the right direction from the center position in a distance in the right direction to the right of center position.

22. The sports training apparatus of claim 21 further comprising:

a handle rod having one end connected to the handle;

means rotatably supporting the handle rod on the frame assembly; and link member means connecting the handle rod to the pad sleeve.

23. The sports training apparatus of claim 22 further comprising:

a guide block connected to the frame assembly having an upper surface, a portion of the handle extending over the upper surface of the guide block, a right groove formed in the upper surface spaced a distance from the center of the guide block, and a left groove formed in the upper surface spaced a distance from the center of the guide block, a portion of the handle being disposed in the right groove when the pad assembly is in the right of center position, and a portion of the handle being disposed in the left groove when the pad assembly is in the left of center position.

24. The sports training apparatus of claim 23 further comprising:

means securing the handle to the guide block when the handle is positioned in the left groove or the right groove.

25. The sports training apparatus supportable on a ground surface and adapted to assist in training a lineman in the sport of football, comprising:

frame assembly supportable on the ground surface, comprising:

pad support bar extending in a plane generally perpendicular to the ground support surface;

pad assembly having an upper end and a lower end;

means supporting the pad assembly on the frame assembly in a stance position wherein the pad assembly is disposed at a predetermined angle with respect to the ground surface and pivotally connecting the pad assembly to the frame assembly whereby the pad assembly is pivotally movable from the stance position toward a raised position and pivotally movable from the raised position to the stance position, the upper end of the pad assembly being movable in a direction toward the frame assembly as the pad assembly moves toward the raised position and the upper end of the pad assembly being movable in a direction away from the frame assembly as the pad assembly moves toward the stance position; comprising;

a pad sleeve rotatably connected to the pad support bar for rotation in a left direction and for rotation in a right direction; and a pad support arm having one end connected to the pad sleeve and an opposite end pivotally connected to the pad assembly; and resistive means cooperating to support the pad assembly in the stance position and for resisting movement of the pad assembly from the stance position toward the raised position, the pad assembly being moveable toward the raised position against a resistive force applied by the resistive means, comprising:

a fluid cylinder connected to the pad assembly and to the frame assembly for applying an adjustably resistive force to the pad assembly resisting movement of the pad assembly in the direction from the stance position toward the raised position.

26. The sports training apparatus of claim 25 wherein the pad and the pad frame are shaped to simulate the appearance of an individual in the stance position with the head portion simulating the individual's head, the torso portion simulating individual's torso and the leg portion simulating a portion of the individual's leg.

27. The sports training apparatus of claim 26 wherein the resistive means comprises:

a fluid cylinder connected to the pad assembly and to the frame assembly for applying an adjustably resistive force to the pad assembly resisting movement of the pad assembly in the direction from the stance position toward the raised position.

28. The sports training apparatus of claim 26 wherein the means for moving the pad assembly to the left of center position, the right of center position and to the center position further comprises:

a handle;

means for connecting the handle to the pad sleeve, the handle being moveable for rotating the pad sleeve and moving the pad assembly from the center position a distance generally in the left direction to the left of center position, and the handle being moveable for rotating the pad sleeve and moving the pad assembly in the right direction from the center position a distance generally in the right direction to the right of center position.

29. The sports training apparatus of claim 28 wherein the means for connecting the handle to the pad sleeve comprises:

a handle rod having one end connected to the handle;

means for rotatingly supporting the handle rod on the frame assembly; and link member means connecting the handle rod to the pad sleeve.

30. The sports training apparatus of claim 21 further comprising:

a guide block connected to the frame assembly having an upper surface, a portion of the handle extending over the upper surface of the guide block, the guide block having a right groove formed in the upper surface spaced a distance from a center of the guide block and a left groove formed in the upper surface spaced a distance from the center of the guide block, a portion of the handle being disposed in the right groove when the pad assembly is in the right of center position, and a portion of the handle being disposed in the left groove when the pad assembly is in the left of center position.

31. The sports training apparatus of claim 30 further comprising:

means for securing the handle to the guide block when the handle is positioned in the left groove or the right groove.

32. The sports training apparatus supportable on ground surface and adapted to assist in training a lineman in the sport of football, comprising:

a frame assembly supportable on the ground surface;

a pad assembly adapted to be engaged by a lineman having an upper end and a lower end, the pad assembly having a head portion near the upper end of the pad assembly and a torso portion disposed between the upper and lower ends of the pad assembly and extending a distance from the head portion toward the lower end of the pad assembly with the head portion extending a distance at an angle from the torso portion;

means for pivotally connecting the pad assembly to the frame assembly whereby the pad assembly is pivotally moveable from a stance position toward a raised position and pivotally moveable from the raised position to the stance position, the upper end of the pad assembly being moveable in a direction toward the frame assembly as the pad assembly moves toward the raised position and the upper end of the pad assembly being moveable in a direction away from the frame assembly as the pad assembly moves toward the stance position, the head portion of the pad assembly extending at an angle to the ground surface in the stance position and the torso portion extending about parallel with the ground surface in the stance position, and the torso portion being movable toward a position extending generally perpendicular to the ground surface as the pad assembly is moved toward the raised position;

means for movably connecting the pad assembly to the frame assembly for movement of the pad assembly in a generally left direction a distance from a center position to a left of center position and for movement of the pad assembly in a generally right direction a distance from the center position to a right of center position and for movement of the pad assembly to the center position; and means connected to the pad assembly for moving the pad assembly to the center position, the left of center position and the right of center position; and wherein the frame assembly further comprises:

a pad support bar extending in a plane generally perpendicular to the ground support surface; and wherein the means for movably connecting the pad assembly to the frame assembly further comprises:

a pad sleeve rotatingly connected to the pad support bar for rotation in a generally left direction and for rotation in a generally right direction; and a pad support arm having one end connected to the pad sleeve and an opposite end pivotally connected to the pad assembly; and wherein the sports training apparatus further comprises:

resistive means for resisting movement of the pad assembly from the stance position toward the raised position, the pad assembly being moveable toward the raised position against a resistive force applied by the resistive means.

* * * * *